US005123191A

United States Patent [19]

Kim

[11] Patent Number: 5,123,191

[45] Date of Patent: Jun. 23, 1992

[54] WALL AND DESK CALENDAR DISPLAY DEVICE

[76] Inventor: Duk K. Kim, 63-20 Samchung-Dong, Chongro-Ku, Seoul, Rep. of Korea

[21] Appl. No.: 698,794

[22] Filed: May 13, 1991

[51] Int. Cl.[5] ..... B43M 3/00

[52] U.S. Cl. ..... 40/358; 40/120; 281/44; 206/474; 283/2

[58] Field of Search ..... 40/358, 360, 661, 649, 40/107, 119, 121, 122, 156, 159, 159.1, 159.2, 904, 534, 373, 374, 324.1, 124.2; 150/147, 149, 154, 165; 283/2-4, 64, 109; 206/44 B, 450, 474, 472; 281/4, 4.1, 31, 34, 35, 44

[56] References Cited

U.S. PATENT DOCUMENTS

| | | | |
|---|---|---|---|
| 1,291,194 | 1/1919 | Shedd | 40/119 |
| 3,016,045 | 1/1962 | Robinson | 40/358 |
| 3,435,868 | 4/1969 | Stermer | 150/147 |
| 3,482,346 | 12/1969 | Woofter . | |
| 3,810,322 | 5/1974 | Ritchie . | |
| 3,883,971 | 5/1975 | Weiss . | |
| 4,016,664 | 4/1977 | Kaufmann | 40/159 X |
| 4,350,195 | 9/1982 | Viesturs et al. | 150/147 |
| 4,423,562 | 1/1984 | Nichols . | |
| 4,523,399 | 6/1985 | Cross . | |
| 4,708,490 | 11/1987 | Arber . | |
| 4,783,922 | 11/1988 | Moore . | |
| 4,863,193 | 9/1989 | Keshani . | |
| 5,022,170 | 6/1991 | House | 40/649 X |

FOREIGN PATENT DOCUMENTS

| | | | |
|---|---|---|---|
| 539299 | 2/1956 | Italy | 40/107 |
| 1198091 | 7/1970 | United Kingdom | 283/2 |

*Primary Examiner*—Joseph Falk
*Assistant Examiner*—James M. Gardner
*Attorney, Agent, or Firm*—Birch, Stewart, Kolasch & Birch

[57] ABSTRACT

A calendar display device includes a panel, a hanger hole disposed at the top center of the panel, a transparent vinyl cover disposed on the front surface for maintaining a calendar pad, and a transparent vinyl back pocket disposed on the rear surface for inserting a memory enhancing sheet thereinto. The calendar display device also includes a pair of lower corner pockets attached to the front surface for receiving the transparent vinyl cover flap.

6 Claims, 1 Drawing Sheet

WALL AND DESK CALENDAR DISPLAY DEVICE

BACKGROUND OF THE INVENTION

1. Field of the Invention

The present invention relates to a wall and desk calendar display device and more particularly, to a combined calendar and calendar frame therefor, which comprises a panel, a hanger hole disposed in the top center of the panel, a transparent vinyl cover disposed on the front surface for maintaining a calendar pad, and a transparent vinyl back pocket disposed on the rear surface for inserting a memory enhancing sheet thereinto.

2. Description of the Prior Art

Various types of calendars and calendar frames are well known in the art. Such combined calendar and calendar frame therefore for separately using as a desk calendar or a wall calendar. Since there is no transparent vinyl cover which is easily locked or opened, it is very difficult to use for a memo calendar. Such calendars and calendar frames disclose as shown in U.S. Pat. No. 3,810,322 to Ritchie, U.S. Pat. No. 3,883,971 to Weiss, U.S. Pat. No. 4,423,562 to Nichols, U.S. Pat. No. 4,523,399 to Cross, U.S. Pat. No. 4,708,490 to Arber, U.S. Pat. No. 4,783,922 to Moore, and U.S. Pat. No. 4,863,193 to Keshani.

SUMMARY OF THE INVENTION

Accordingly, it is an object of the present invention to provide an improved calendar display device which eliminates the above problems encountered in a conventional calendar display device.

Another object of the present invention is to provide a wall and desk calendar which can be hung on the wall by utilizing a hanger hole disposed in the top center thereof or put on the desk for recording current and near-future events of transient significance thereon.

A further object of the present invention is to provide a combined calendar and calendar frame therefor, which eliminates the above problems encountered in a conventional combined calendar and calendar frame therefore and comprises a calendar pad disposed between a visual front cover and the front surface of a panel and a memory enhancing sheet for inserting into a visual pocket disposed on the rear surface of the panel.

Other objects and further scope of applicability of the present invention will become apparent from the detailed description given hereinafter. It should be understood, however, that the detailed description and specific examples, while indicating preferred embodiments of the invention, are given by way of illustration only, since various changes and modifications within the spirit and scope of the invention will become apparent to those skilled in the art from this detailed description.

Briefly described, the present invention relates to a calendar display device including a panel, a hanger hole disposed at the top center of the panel, a transparent vinyl front cover disposed on the front surface for maintaining a calendar pad, and a transparent vinyl back pocket disposed on the rear surface for inserting a memory enhancing sheet thereinto.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DESCRIPTION OF THE PREFERRED EMBODIMENTS

Figure 1:
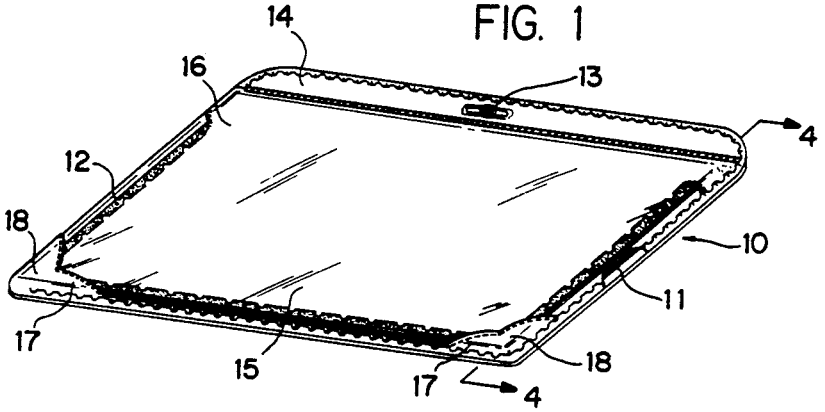
FIG. 1 is a perspective view of the calendar display device according to the present invention.
Figure 2:
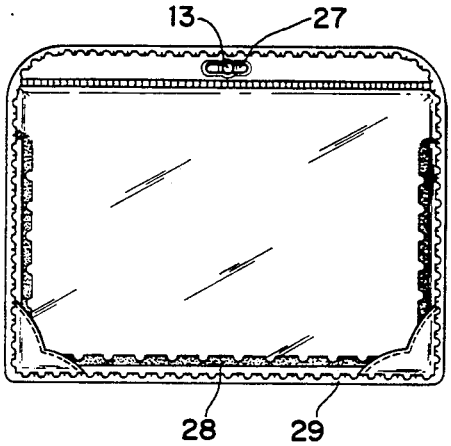
FIG. 2 is a front elevational view of the calendar display device according to the present invention.
Figure 3:
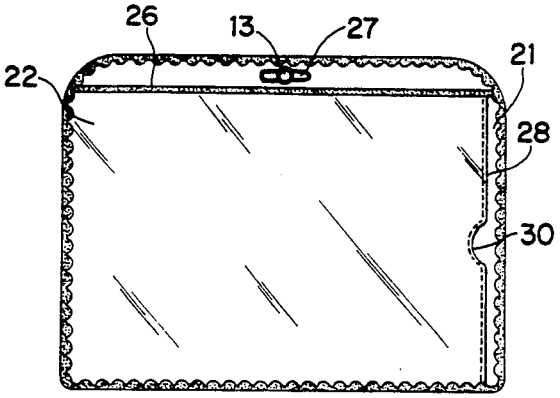
FIG. 3 is a rear elevational view of the calendar display device according to the present invention.
Figure 4A:
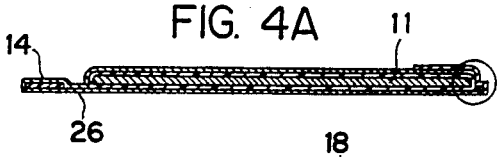
FIG. 4 is a sectional view of FIG. 1, taken along line 4—4.
Figure 4B:
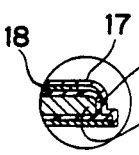

Referring now in detail to the drawings for the purpose of illustrating preferred embodiments of the present invention, the wall and desk calendar display device 10 as shown in FIGS. 1, 2, 3, and 4, comprises a basic panel 11 covering a color vinyl cover sheet 12, a hanger hole 13 disposed in the center of a color vinyl top portion 14, a transparent vinyl front cover 15 extending from a transparent vinyl top cover 16, a pair of both transparent lower corner pockets 17 for locking a pair of both end corners 18 of the front cover, and a transparent back pocket cover 22 for forming a back pocket 21 so as to inserting a memory enhancing sheet 23 thereinto. Also, the back pocket cover 22 has a slot portion 30 for easily handling the memory enhancing sheet 23.

Figure 5:
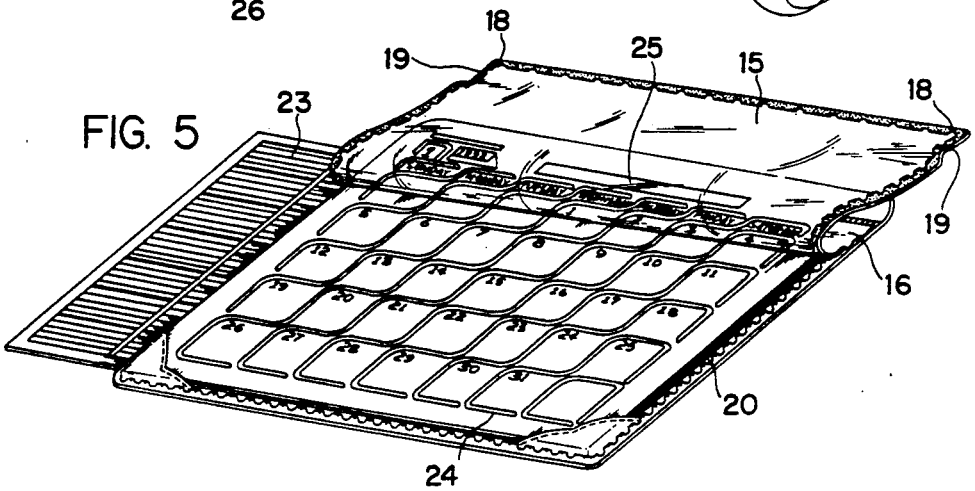
FIG. 5 is a perspective view of the combined calendar and calendar display device therefor according to the present invention.

After the front cover 15 is opened, a calendar pad 20 such as a plurality of successive calendar sheets is inserted into the top cover 16 and the pair of both lower corner pockets 17. Thereafter, the front cover 15 is closed and the pair of both end corners 18 are easily inserted into the pair of both lower corner pockets 17 since the pair of both end corners 18 have a gradually reduced side configuration 19, respectively. Then each of the plurality of successive calendar sheets 20 has imprinted thereon indicia 24, for example, representative of the name of year, month, day-dates, and an advertisement 25 as shown in FIG. 5.

Accordingly, the calendar display device 10 including the calendar pad 20 is used as a desk calendar and the user may record current and near future events of transient significance on the space in the vicinity of each day-dates or the transparent vinyl front cover 15. Also, if necessary, the other calendar sheets 20 can be recorded after taking out the lower ends of the calendar sheets 20 from the pair of both lower corner pockets 17, respectively. The transparent vinyl top cover 16 forms a pocket for tightly inserting the upper ends of the calendar pad 20 thereinto. Furthermore, it is easily showed the name of year, month, week, and the advertisement 25. That is, as shown in FIG. 5, the front cover 15 may be folded at a line of the name of week when the front cover 15 is opened.

The hanger hole 13 of the calendar display device 10 is vertically supported the same on any convenient hook or similar suspending means. Therefore, the calendar display device 10 including the calendar pad such as the plurality of successive calendar sheets 20 is used as a wall calendar and the user may record current and near future events of transient significance on the space in the vicinity of each day-dates or the transparent vinyl front cover 15.

The calendar display device 10 further includes a decorative line 26 disposed between the top portion 14 and the top cover 16, many kinds of decorations 28 disposed on edges of transparent vinyl members of the front cover 15, the back pocket cover 22, and both corner pockets 17. Also, the calendar display device 10 further includes a color vinyl decoration 29 disposed on edges of the basic panel 11 and a pair of hole side decorations 27 disposed on both side portions of the hanger hole 13.

The invention being thus described, it will be obvious that the same may be varied in many ways. Such variations are not to be regarded as a departure from the spirit and scope of the invention, and all such modifications as would be obvious to one skilled in the art are intended to be included in the scope of the following claims.

What is claimed is:

1. A calendar display device for using as a wall calendar frame and a desk calendar frame, which comprises:

a basic panel covered with a color vinyl, said vinyl covered basic panel having a color vinyl top portion disposed at the upper portion thereof, a hanger hole disposed in the center of said vinyl top portion, a transparent vinyl front cover extending from a transparent vinyl top portion which is attached to the lower edge of said color vinyl top portion, a pair of lower corner pockets attached to a pair of lower corners of the front surface of said basic panel for locking with a pair of end corners of the front cover so as to maintain a calendar pad, and a transparent vinyl back pocket disposed on the rear surface of said basic panel for receiving a memory enhancing sheet.

2. The calendar display device of claim 1, wherein each of said pair of end corners has a reduced side configuration, respectively.

3. The calendar display device of claim 1, wherein said back pocket has a slot portion for easily handling the memory enhancing sheet.

4. A combined calendar and calendar display device therefor for using as a wall calendar and a desk calendar, which comprises:

a basic panel covered with a color vinyl, said vinyl covered basic panel having a color vinyl top portion disposed at the upper portion thereof, a hanger hole disposed in the center of said vinyl top portion, a transparent vinyl front cover extending from a transparent vinyl top portion which is attached to the lower edge of said color vinyl top portion, a pair, of lower corner pockets attached to a pair of lower corners of the front surface of said basic panel for locking with a pair of end corners of the front cover, a calendar pad inserted between said front cover and a front surface of said basic panel, a transparent vinyl back pocket, and a memory enhancing sheet inserted into said back pocket.

5. The calendar display device of claim 4, wherein each of said pair of end corners has a reduced side configuration, respectively.

6. The calendar display device of claim 4, wherein said back pocket has a slot portion for easily handling the memory enhancing sheet.

* * * * *